US006584732B2

(12) United States Patent
Miller et al.

(10) Patent No.: US 6,584,732 B2
(45) Date of Patent: Jul. 1, 2003

(54) SUPER SHOW DOME

(75) Inventors: Chris Kinglsey Miller, Newington (AU); Tom Zayit, Emu Plains (AU)

(73) Assignee: Inflatable Image Technologies Pty. Limited, Sydney (AU)

( * ) Notice: Subject to any disclaimer, the term of this patent is extended or adjusted under 35 U.S.C. 154(b) by 0 days.

(21) Appl. No.: 09/984,882

(22) Filed: Oct. 31, 2001

(65) Prior Publication Data

US 2003/0019168 A1 Jan. 30, 2003

(30) Foreign Application Priority Data

Jul. 27, 2001 (AU) ..... PR6660

(51) Int. Cl.[7] ..... E04G 11/04; E04H 15/20

(52) U.S. Cl. ..... 52/2.11; 52/2.13; 52/2.17; 52/2.23; 52/2.22; 52/2.25

(58) Field of Search ..... 52/80.2, 81.3, 52/82, 83, 86, 88, 2.11, 2.13, 2.17, 2.23, 2.22, 2.25, 2.21, 23

(56) References Cited

U.S. PATENT DOCUMENTS

RE27,232 E * 11/1971 McLorg ..... 52/2
4,676,032 A * 6/1987 Jutras ..... 52/2.17
4,802,734 A * 2/1989 Walter ..... 359/443
4,932,169 A 6/1990 Charbonneau ..... 52/2
5,675,938 A * 10/1997 McLorg ..... 52/2.26
5,772,535 A 6/1998 Murphy ..... 473/415
5,893,238 A 4/1999 Peacock et al. ..... 52/2.18
6,282,842 B1 9/2001 Simens ..... 52/2.11

* cited by examiner

*Primary Examiner*—Jeanette Chapman
(74) *Attorney, Agent, or Firm*—Robert Platt Bell

(57) ABSTRACT

An inflatable object includes interior attachment points to opposing interior faces of the object and rope or cord connections between these attachment points. The opposing walls have interior faces which include attachment points adapted to be connected together by predetermined lengths of material, the arrangement being such that upon inflation of the device, the walls are held in position relative to one another by the lengths of material. The connection material between the inner and outer panels is a flexible cord-like material. However any appropriate material may be used. The attachment points are located on webbing strips attached to the interior face of each wall at a seam, provided with eyelets. In the preferred embodiment, the cords are maintained at an angle substantially or averaging substantially 90 degrees from the inner and outer surfaces.

18 Claims, 8 Drawing Sheets

SUPER SHOW DOME

FIELD OF THE INVENTION

The present invention relates to the area of cold air inflatable structures and systems including creation of large items such as enclosures and structures such as tent-like and tunnel inflatables. In particular, the present invention is directed toward an inflatable structure having interior and exterior fabric walls tied together with mesh or cords.

BACKGROUND OF THE INVENTION

In the present Specification, the term "cold air inflatable system" is used to distinguish between hot air inflatable structures (e.g., hot air balloons) and cold air inflatable structures (e.g., tents, domes, and other structures) which use air pressure (e.g., fan) to inflate and maintain shape. Cold air inflatable systems are generally inflated by the injection of cold air introduced through a low pressure high volume fan (e.g., forward curve "squirrel cage" type fan).

Inflatable structures are known in the art. Typical cold air inflatable products are usually manufactured from PVC (polyvinyl chloride), nylon, and similar materials and may be shaped into a multiplicity of designs and sizes. However, Prior Art construction techniques have limited some design aspects of inflatable structures.

One of the most commonly known inflatable structures is the inflatable dome, such as used for athletic arenas or facilities (e.g., Carrier Dome, Syracuse N.Y.). In a stadium embodiment, a large fabric dome may be attached to the stadium which in turn is pressurized to support the dome into a convex shape. In smaller applications (e.g., tennis enclosure) the dome material may be attached directly to the ground and the entire structure inflated.

An example of an inflatable arena dome is illustrated, for example, in Simens, U.S. Pat. No. 6,282,842, issued Sep. 4, 2001, and incorporated herein by reference. Simens discloses a sports stadium or building complex covered by a huge fiberglass fabric dome supported by an inflatable dual-membrane bladder on a hollow compression ring with a diameter of 800 to 1200 feet. A central vertical spreader having upper and lower tension rings connected to the membranes of the bladder is supported from above or below by separate suspension cables in a position above the compression ring. Containment cables limit the expansion of and shape the bladder to provide a closed pressurized air space of narrow lenticular cross section and can include 40 or more radial ceiling cables and the same number of radial hold-down cables of the same length.

One problem with such systems is that they require that the interior of the structure be maintained at a pressure higher than the surrounding atmospheric pressure. Thus, at each entrance, an airlock need be provided in the form of a revolving door or the like. Rapid ingress and egress is not readily achieved, and large open areas (i.e., open to the elements) are not possible. Moreover, such structures are not readily portable, as they must be attached and sealed against a structure or the ground. Thus, such designs are generally unsuitable for tents, pavilions, and the like, where large entryways and openings are desired and portability is a requirement.

Other types of inflatable structures are known in the art such as jumping castles, product replicas, billboards, and the like. Most of these products are merely inflatable envelopes which are pressurized by a small fan. Jumping castles, however, may be formed as structure having an internal cavity for users to enter.

In such an embodiment, walls and structure may be formed by joining inner and outer panels together (or via an intermediate strip) to form a series of inflatable adjoining "tubes". The difference in pressure between the inside of the inflatable and the outside provides sufficient surface tension for the device to have sufficient rigidity to maintain its shape.

An example of such a tube construction is illustrated, for example, in Peacock et al., U.S. Pat. No. 5,893,238, issued Apr. 13, 1999, and incorporated herein by reference. Peacock discloses an inflatable tent construction including an upper wall unit and a lower wall unit having a plurality of vertically aligned inflatable tubular chambers wherein the lower wall unit is operatively connected to a floor unit and provided with a plurality of tent opening units. A plurality of inflatable circular rings encircle the periphery of the floor unit, the lower wall unit, and the upper wall unit, respectively.

While such a structure may maintain a desired shape and appearance, the use of this tube-type assembly makes the structure fairly heavy and complex. As a result, such inflatable technology does not scale well into larger structures such as large tents and the like.

Traditional construction of many inflatable products has required the use of an inner and outer wall separated by a series of internal walls or baffles of similar materials to the main walls in order to give the device being manufactured sufficient strength and stability. However, such construction adds significantly to the weight of the inner and outer walls along and can contribute up to a 40% increase in the total weight of the an inflatable device. Moreover, the addition of internal walls or baffles increases the deflated size of the structure, making the structure harder to store and ship. In addition, such inflatable devices are slow to inflate and deflate, as considerable time is needed to fill each "tube" or cavity in the structure.

Attempts have been made to overcome the defects of such Prior Art structures. One example of such a structure may be found in Charbonneau, U.S. Pat. No. 4,932,169, issued Jun. 12, 1990 and incorporated herein by reference. Charbonneau discloses a rather elaborate inflatable structure comprising a double wall pneumatic envelope including top and bottom panels. The inflatable structure also includes a central mast and a series of peripheral poles. A central portion of the bottom panel is mounted to a top end of the mast, whereas the bottom end of the mast is secured to the ground. The poles are connected at their upper and lower ends respectively to peripheral portions of the envelope and to the ground. However, the addition of the central and peripheral poles makes setting up the structure time consuming and moreover increases the bulk of the structure when folded and packed for shipping or storage.

SUMMARY OF THE INVENTION

It is an object of the present invention to provide a means of producing an inflatable object which results in a lighter weight product than previous such objects and which is more efficiently inflated and deflated.

In one embodiment of the present invention, a method of constructing an inflatable object includes the steps of providing attachment points to opposing interior faces of the object and connecting these attachment points by means of predetermined lengths of connection material prior to inflation.

The invention also includes an inflatable device formed by the above method and having opposing walls having interior faces which include attachment points adapted to be connected together by predetermined lengths of material, the arrangement being such that upon inflation of the device, the walls are held in position relative to one another by the lengths of material.

It is preferred that the connection material between the inner and outer panels be a cord-like material and it is also preferred that the material used may be flexible. However any appropriate material may be used. It is further preferred that the attachment points be located on base members attached to the interior face of each wall and that the attachment points take the form of eyelets.

DETAILED DESCRIPTION OF THE INVENTION

In order that the invention may be more readily understood, the preferred embodiment of the present invention will now be described. The description of the preferred embodiment should in no way be construed as limited the spirit and scope of the present invention in any way.

Figure 1:
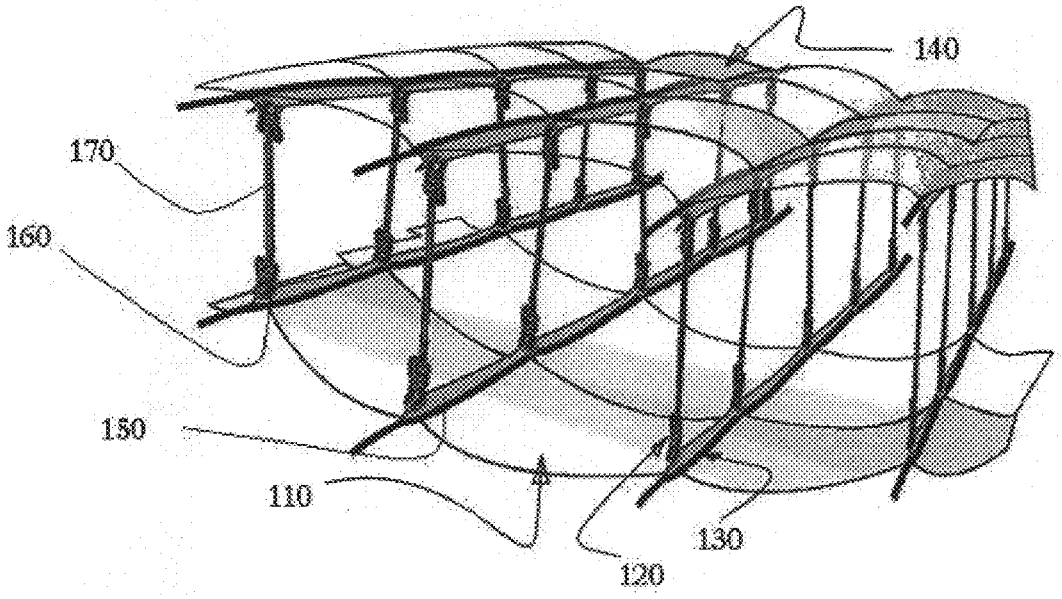
FIG. 1 is a perspective view of a portion of the structure of the present invention.

FIG. 1 is a perspective view of a portion of the structure of the present invention. The method of construction of the present invention may be used to manufacture any shaped inflatable object from small objects up to and including stadiums and the like. As noted above, inflatables such as the present invention may be manufactured using a panel material such as PVC or the like.

In the preferred embodiment of the present invention, a material sold under the name of "GlowCote" may be used for the inner and outer panels 110 and 140, respectively. Glowcote is a woven nylon substrate with vinyl coatings applied to both sides. These vinyl coatings may include a UV inhibitor, pigment, and anti-cracking compounds. GlowCote is made with an FR finish (F.A.R. 25.853) U.S. Department of Transportation (Flame_retardency) Specification. Of course, other materials may be used for inner and outer panels 110, 140, without departing from the spirit and scope of the present invention.

As illustrated in FIG. 1, inner and outer panels 110, and 140 may be provided in portions, preferably strips or the like, sewn together along seams 130. Seams 130 may be sewn using predominantly French-fold (overlap-and-return, like clenching the fingers of one hand curled under the other) and oversewn on the tucked fold with a ¼" and ½" double-lock-stitch (dual-stitch/twin-thread). Where French fold is not practicable due to the bulk not being able to pass through the folder attached to the sewing machine, butt-seams may be used with a double-lock stitch.

Running along the length of most seams is a webbing 150 sewn into the seam as noted above. Webbing 150 may comprise, for example 1500 Kg burst strength seatbelt webbing as commonly known in that art. Located periodically throughout webbing 150 are a plurality of grommets 160 (e.g., brass, aluminum, or the like). Grommets 160 provide a means for attaching catcords 170 which may be tied to grommets 160 with knots. Catcords 170 are secured in pre-determined lengths according to their locations within the dual wall cavity to brass eyelets 160 which are fixed to the heavy-duty webbing 150. Catcords 170 may comprise lightweight synthetic braided cordage of 1/10" to ⅛" in diameter, although other sizes may be used.

Catcord eyelets may be spaced apart by a regular or irregular amount, depending upon the desired shape and appearance. Spacing between catcord eyelets may also be determined by mathematical structural analysis to prevent the structure from bowing, bending, or collapsing.

The location of catcords 170 relative to inner and outer panels 110 and 140 is one the keys to maintaining a desired shape in the present invention. One reason Prior Art inflatables use interior walls is that it was thought in the Prior Art that such walls were necessary to maintain a desired shape. One key to using catcords as opposed to an interior wall is to insure that the catcord is substantially at a 90 degree angle relative to the surface at the intersecting panel (i.e., normal to the surface). It should be appreciated by one of ordinary skill in the art that the angle of catcord 170 relative to the surface need not be exactly 90 degrees, but should be within a range of approximately ±15 degrees of normal.

Moreover, it is possible to maintain catcords at other angles so long as the average or net angle of all the catcords is substantially 90 degrees. Thus, for example, one catcord may be at an angle of 75 degrees, whereas an adjacent catcord may be at an angle of 105 degrees. The average of the two catcord angles is 90 degrees, and thus the non-perpendicular vectors cancel each other out. By placing the catcords at substantially 90 degrees (or averaging substantially 90 degrees) the cords are each (or cumulatively) placing stress on the inner and outer panels at an angle perpendicular to the panel plane. Thus, the desired shape of the object may be substantially maintained.

However, it should be noted that within the spirit and scope of the present invention, it is possible to place catcords in the apparatus intentionally at angles which are not substantially 90 degrees (or average 90 degrees) to intentionally distort the structure into a desired distorted shape. Moreover, in certain applications (corners, sharp angles, end pieces, entryways, and other non-uniform surfaces) such off-angle positioning may be desired. However, in the preferred embodiment, for substantially planar surfaces, a substantially 90 degree catcord installation is used.

Figure 2:
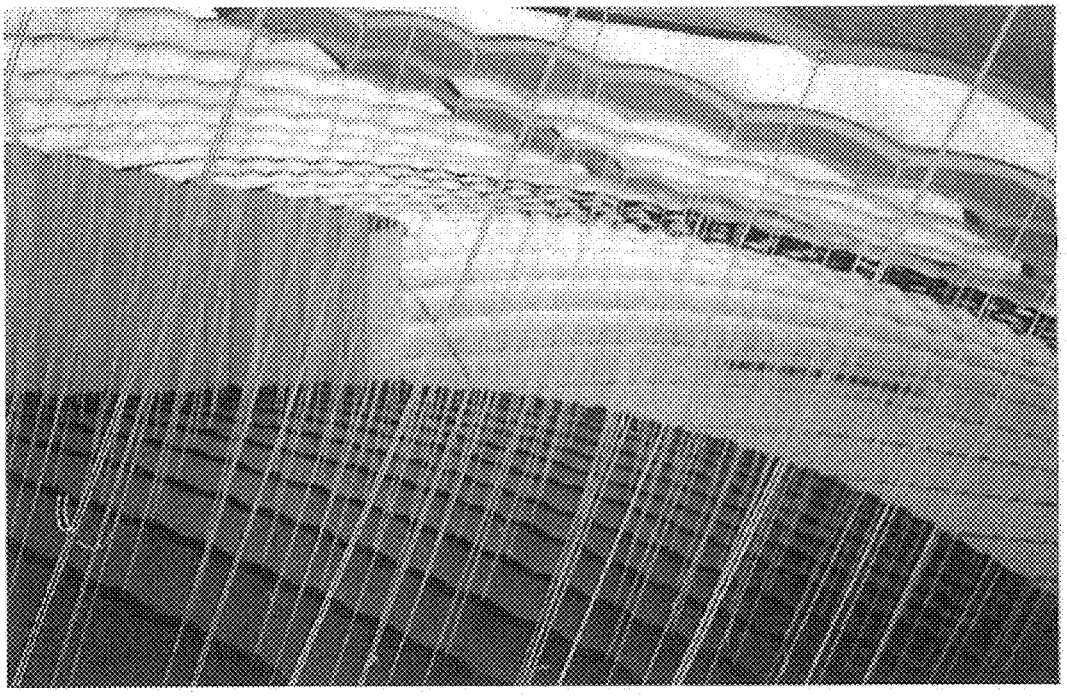
FIG. 2 is an internal view of the structure of the present invention illustrating the inner and outer panels and connecting materials.

It should also be noted that while an inflatable structure of the present invention may be designed using substantially 90 degree catcord installation, variations in actual construction, catcord lengths, and the like, as well as installation location (e.g., on a hill or uneven surface) may result in the catcords being off the desired 90 degree angle as illustrated in FIG. 2.

FIG. 2 is an internal view of the structure of the present invention illustrating the inner and outer panels and connecting materials. FIG. 2 is taken from an actual photograph of an interior portion of an apparatus constructed according to the present invention. As illustrated in FIG. 2, the catcords are somewhat off from 90 degrees.

Figure 3A:
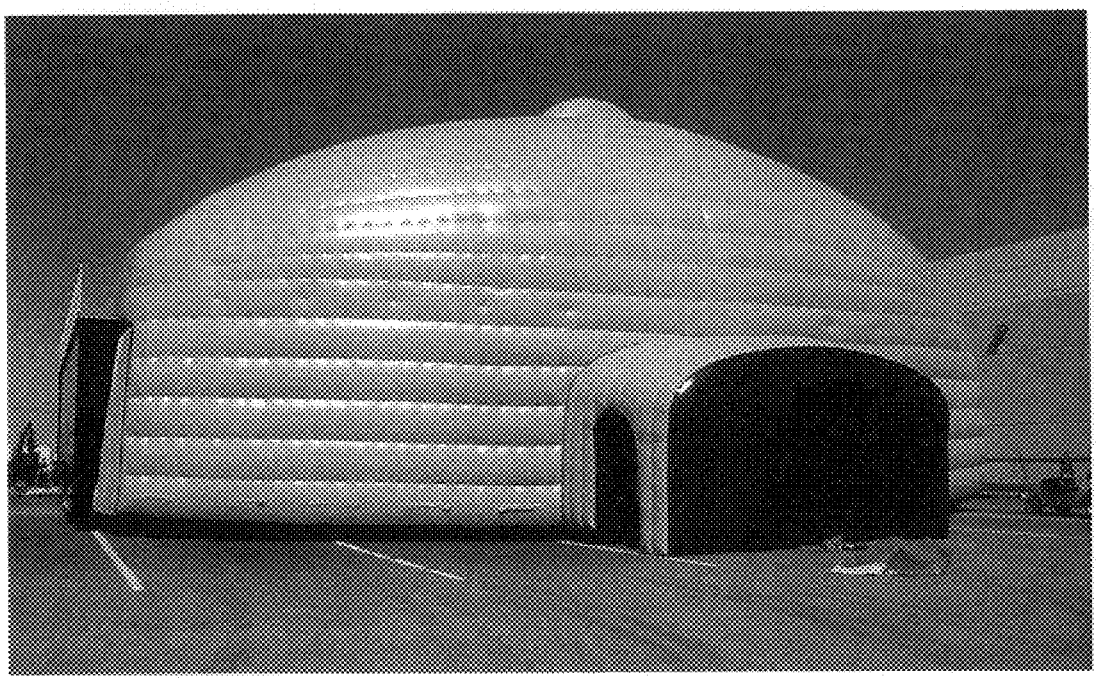
FIG. 3A is a perspective view of a display pavilion manufactured using the construction technique of the present invention, illustrating the unique surface effect produced by the present invention.

FIG. 3A is a perspective view of a display pavilion manufactured using the construction technique of the present invention, illustrating the unique surface effect produced by the present invention. One effect produced by the apparatus and method of the present invention is that unlike Prior Art "tube" constructions, the resulting object does not have a tube-like surface effect. Rather, as illustrated in FIG. 3A, the resulting structure takes on an aesthetically pleasing puffy look similar to that of a down jacket or the like.

As will be discussed in more detail below, the apparatus of FIG. 3A may be folded out from a semi-trailer, the floor of which may then become a stage or display area. Due to the compact size of the present invention (as opposed to tube-type construction) the entire structure can be folded in one piece into the semi-trailer. Moreover, since there are no individual tubes to inflate, the structure of the present invention may be inflated and set up as well as deflated and stored in less than half the time of a comparable tube construction structure.

It should be noted that although the embodiment of FIG. 3A is illustrated as being attached to one or more semi-trailers, such attachment is not required in the present invention. The embodiment of FIG. 3A may be useful for a travelling road show or exhibit. However, the structure of the present invention may be implemented without any trucks or trailers or other hard-walled structure. An embodiment may be constructed with four (or more) independent walls such that the entire structure is inflatable.

Figure 3B:
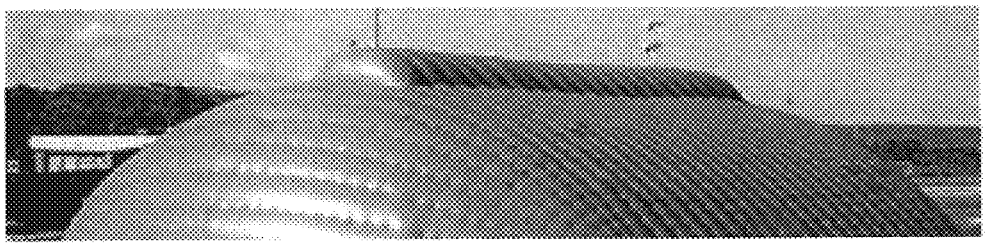
FIG. 3B is a perspective view illustrating another unique feature of the present invention, the use of a roof center-ridge, which runs longitudinally along the rooftop of the structure of FIG. 3A.

FIG. 3B illustrates another unique feature of the present invention, the use of a roof center-ridge, which runs longitudinally along the rooftop of the structure of FIG. 3A. The center-ridge comprises an inflatable semi-circular or curved structure running along the top center of the roof. The roof center-ridge provides a number of major benefits. As it has no "pitch" per se, but rather is curved, the center ridge provides extremely fast and effective water run-off in a downpour.

Any sewn seam or stretch-point on a Prior Art canvas or vinyl inflatable (or even non-inflatable) structure without such a curved center-ridge may allow water ingress either by water seeping through stitching holes in the seam depressions or by capillary action of water tracking its way through after it has been "sitting" in a seam depression.

In the present invention, water ingress may be countered by use of the center-ridge, which allows water to shed from the top centerline of the structure, allowing water run-off and preventing water from "sitting" on top of the dome. As the outer surface of the dome sheds water, the dome dries more quickly, and capillary action has less of an opportunity to occur.

In addition, the center-ridge allows for quicker erection of the structure by minimizing the tendency of the structure to collapse during the inflation process. The center ridge acts as a stiffening rib to provide the structure with additional stiffness. Moreover, the center-ridge provides for greater conformity of the intended roof-shape when inflated by reducing the tendency of the middle portion of the roof to droop.

Figure 4:
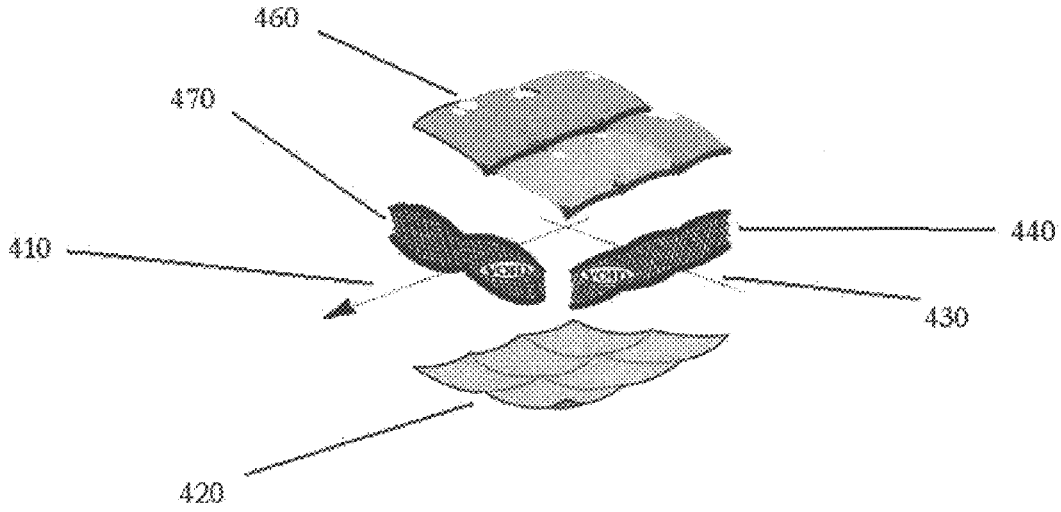
FIG. 4 is a perspective exploded view of an alternative embodiment of the present invention, whereby a mesh is used in place of cord to connect the inner and outer panels.

FIG. 4 is a perspective exploded view of an alternative embodiment of the present invention, whereby a mesh is used in place of cord to connect the inner and outer panels. In the embodiment of FIG. 4, upper and lower panels 460 and 420, respectively, may be provided as in the embodiment of FIG. 1. However, in place of catcords 170 of FIG. 1, woven meshes 470 and 440 may be provided to connect lower panel 420 to upper panel 460. Woven meshes 470 and 440 may comprise, for example, a lightweight nylon woven mesh as commonly used in camping gear, swimsuits, the like.

Woven meshes 440 and 470, provided with a series of voids therein, allow air to pass from one portion within the structure to another more quickly than Prior Art tube-wall construction, reducing set-up and knock-down times. Moreover, the meshes 440 and 470 are lightweight and fold into a smaller space than a solid wall, thus allowing the entire structure to be more easily transported.

Note that although two orthogonal meshes are illustrated in FIG. 4, a single mesh may be used within the spirit and scope of the present invention, or meshes at other angles relative to one another may be used (particularly on curved surfaces, corners, and the like). Note that the meshes, like the catcords, are nominally at a 90 degree angle relative to tangents of the inner and outer surfaces. As with the catcords, the meshes may lie substantially at (or average) a 90 degree angle in one embodiment, or may be angled in embodiments were distortion of the surface are desired.

Figure 5:
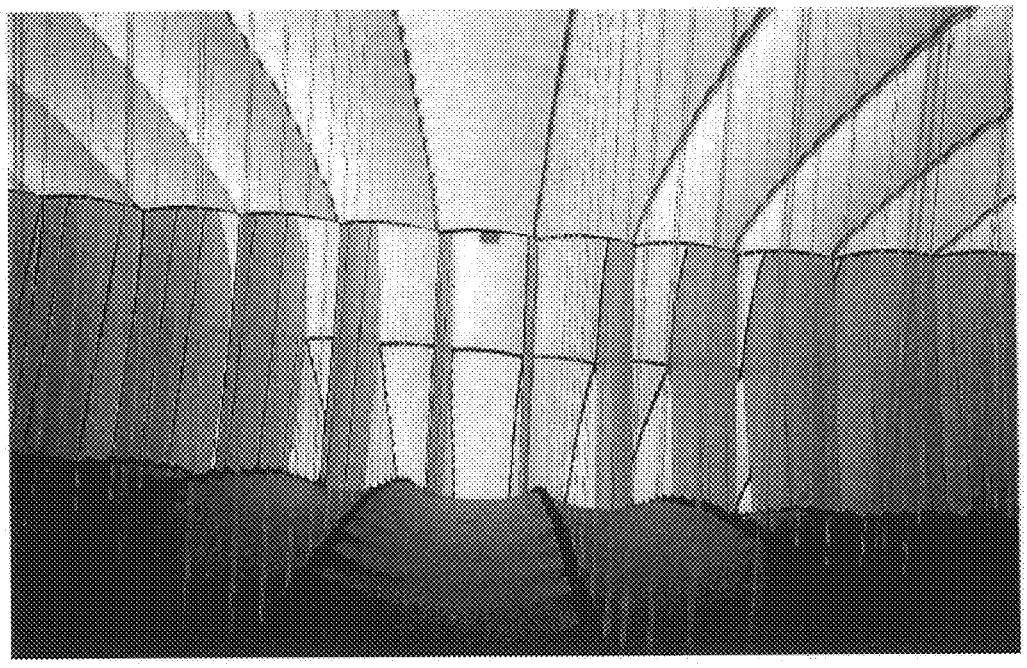
FIG. 5 is a perspective view of an interior portion of a structure manufactured according to the present invention, illustrating the use of combined construction techniques.

FIG. 5 is a perspective view of an interior portion of a structure manufactured according to the present invention, illustrating the use of combined construction techniques. In the illustration of FIG. 5, the catcords are illustrated in this fairly level section as substantially perpendicular to both the upper and lower surfaces. Note in this illustration the use of solid panel portions in the far background as a means of augmenting the catcords. The system of the present invention may be utilized in conjunction with other technologies, such as solid panel portions or even tube sections without departing from the spirit and scope of the present invention. Solid panels may be used, for example, at curved portions or at junctions, joints, or entryways, where a more defined structure may be desired.

Figure 6:
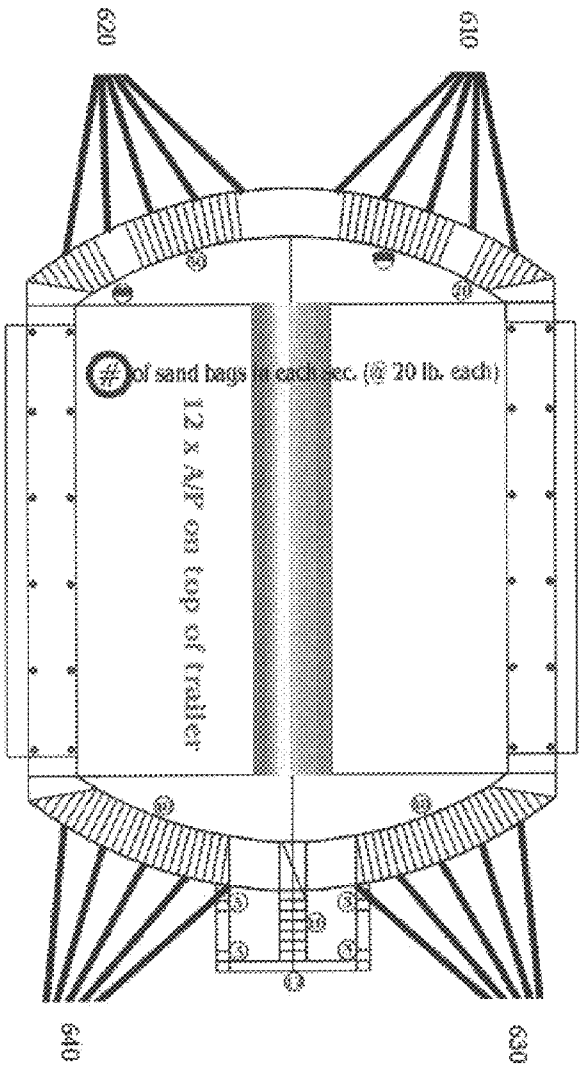
FIG. 6 is a top plan view illustrating the installation of the structure of FIG. 3A between two semi trailers, illustrating the locations of sandbags and/or tiedowns.

FIG. 6 is a top plan view illustrating the installation of the structure of FIG. 3A between two semi trailers, illustrating the locations of sandbags and/or tiedowns. In the illustration of FIG. 6, a number of tiedowns 610, 620, 630, and 640 may be provided to secure the structure to the ground to prevent the structure from being blown away or lifting up. Tiedowns may take one of several forms. Traditional ropes and D-rings or the like may be provided to allow the structure to be tied or pegged to the ground.

In the present invention, however, sandbags may be used to secure the structure in a manner which is aesthetically pleasing and easy to install. Zippered panels in the base of the structure may be provided for sandbag access at ground level, allowing entry/egress from the wall cavity pockets, for placement and removal of sandbag anchor weights of approximately 20 pounds each. The sandbags may be placed onto the bottom portion of the inside cavity of the structure. This bottom surface may be reinforced against abrasion and the like.

Due to the free-flowing aspect of the present design, fairly large zippered access panels may be provided to allow installation of sandbags. Even a panel several feet across can be opened without the structure being compromised (provided sufficient fan airflow is available). This allows access panels to be placed in the structure for maintenance access while the structure is inflated. Moreover, this allows the structure to be somewhat vandal-proof such that members of the public attempting to puncture or deflate the structure will find their efforts largely thwarted.

In locations where sandbag weights are a sourcing problem or inapplicable, or not preferred, the structure has built-in tie-off points for tie-down ropes to be secured to fixed or move-into-position heavy objects. The reinforced tie-off points (stainless steel D rings) in the outer wall may be reinforced via oversewn load spreading patches on the direct or reverse side of the outer wall, which in turn may be connected to reinforced patches on the inside of the inner wall with D-rings for connecting bracing webbing from inner D-ring to inner D-ring. Alternately, the two patches from the inner and outer surfaces may be coupled via catcord, mesh, or panel as discussed above.

Figure 7:
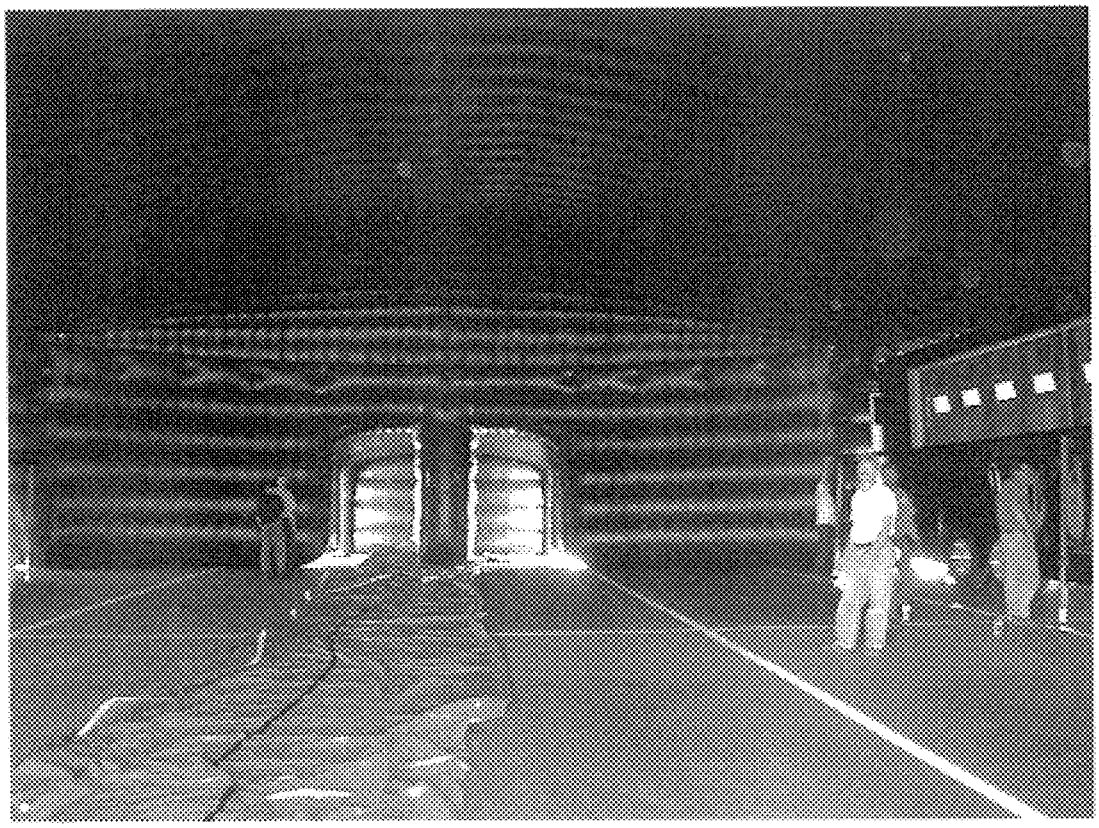
FIG. 7 is an interior view of the structure of FIG. 3A illustrating how the structure may be attached to a semi-trailer and also how the structure may be made open to the elements.

FIG. 7 is an interior view of the structure of FIG. 3A illustrating how the structure may be attached to a semi-trailer and also how the structure may be made open to the elements. The embodiment of FIGS. 3A and 7 is designed to showcase a product where light ingress is not desired. Thus, in the embodiments of FIGS. 3 and 7, the inner and outer panels have been coated with a substantially opaque material so as to reduce the amount of light entering the structure.

In addition, as seen at the rear of the interior image of FIG. 7, an entryway may be provided as a light box to shield outside light from the interior of the structure. Even with this entryway in place, it is not necessary to provide a sealed door or the like as in inflatable domes. Note also in FIG. 7 how the structure may be tied to a semi-trailer or the like which may be used, in this instance, as a product display stand.

While the preferred embodiment and various alternative embodiments of the invention have been disclosed and described in detail herein, it may be apparent to those skilled in the art that various changes in form and detail may be made therein without departing from the spirit and scope thereof.

For example, although the connection means illustrated herein in the preferred embodiment is a catcord tied to opposing eyelets, other types of rope, strap, wire, or wire rope, or webbing could be used and other types of attachment could be used. For example, ropes could attach to the eyelets via a snap clip, snap button, or the like, or be sewn in place. Similarly, straps, mesh or webbing could be sewn to the fabric or to a webbing strip attached at the fabric seam instead of using tied catcords. However, one advantage of the tied catcords is the ability to adjust the final shape of the structure by adjusting catcord lengths via maintenance and access ports discussed above.

In addition, while the catcords are illustrated in the preferred embodiment as being attached to a webbing at the seams of the panels, ropes or other bonding means could be attached directly to the interior faces of the object walls rather than being attached to material sewn to the wall faces. Moreover, any combination of these alternative embodiments may be used in concert to provide different structural capabilities in different stress points of the structure.

It should also be emphasized that the method and apparatus of the present invention may be applied to structures of all sizes, not just large inflatable structures. Thus, for example, the technology of the present invention could be used to form a lightweight and inexpensive inflatable tent, toy, or the like. Similarly, the technology of the present invention could be applied to a number of differently shaped objects in addition to structures.

In addition, while the present invention has been disclosed in its preferred embodiment as a dual-wall system (inner and outer panels with an inflatable cavity in between) other embodiments are also possible. For example, three, four or more layers may be used if desired for particular applications. For example, multiple layers may be used to provide inflation safety redundancy. If one inflatable cavity is severely compromised (e.g., vandalism or accident) the remaining cavity layers may support the structure. In addition, multiple layers may be used in larger structures to provide additional structural support.

Moreover, multiple layers may be used for insulation purposes, or to provide internal HVAC supply by ducting heated or cooled (or outside) air though an internal cavity to portions of the inside structure via ducts, hoses, or openings in the internal wall.

In addition, the apparatus of the present invention may be provided as a series of interconnected modular structures, which may be of particular use when a larger structure is desired. A number of separate inflatable structures may be assembled together to form a single larger inflatable structure of group of structures.

We claim:

1. An inflatable structure, comprising:

a first external panel provided as a pressure barrier for the inflatable structure;

a second panel substantially parallel to the first panel as a pressure barrier for the inflatable structure such that the first and second panel form a cavity therebetween inflated with pressurized gas; and at least one cord attached to the first panel and the second panel for substantially retaining the first panel and second panel in a predetermined relationship to one another against pressure from the pressurized gas, wherein said first panel further comprises at least two panel strips attached to one another and to a first webbing strip, the first webbing strip being substantially perpendicular to the first panel when the structure is inflated, wherein the at least one cord is attached to the webbing strip, wherein said second panel further comprises at least two panel strips attached to one another and to a second webbing strip, the second webbing strip being substantially perpendicular to the first panel when the structure is inflated, wherein the at least one cord is attached to the second webbing strip, wherein said first webbing strip further includes at least one grommet attached to the first webbing strip, for attaching the at least one cord, wherein said second webbing strip further includes at least one grommet attached to the second webbing strip, for attaching the at least one cord, wherein each of said at least one cord is attached to said first panel at an angle substantially normal to the surface of the first panel, and wherein the said at least one cord comprises a plurality of cords, and wherein the average angle of attachment of the cords relative to their respective attachment points in the first panels is substantially 90 degrees.

2. A inflatable structure, comprising:

a first external panel provided as a pressure barrier for the inflatable structure;

a second panel substantially parallel to the first panel as a pressure barrier for the inflatable structure such that the first and second panel form a cavity therebetween inflated with pressurized gas; and at least one mesh attached to the first panel and the second panel for substantially retaining the first panel and second panel in a predetermined relationship to one another against pressure from the pressurized gas, wherein said first panel further comprises at least two panel strips attached to one another and to a first webbing strip, wherein the at least one mesh is attached to the webbing strip.

3. The inflatable structure of claim 2, wherein said second panel further comprises at least two panel strips attached to one another and to a second webbing strip, wherein the at least one mesh is attached to the second webbing strip.

4. The inflatable structure of claim 1, wherein said at least one mesh is attached to said first panel at an angle substantially normal to the surface of the first panel.

5. The inflatable structure of claim 1, wherein said at least one mesh comprises a plurality of meshes, and wherein the average angle of attachment of the meshes relative to their respective attachment points in the first panels is substantially 90 degrees.

6. An inflatable structure, comprising:

a first external panel provided as a pressure barrier for the inflatable structure;

a second panel substantially parallel to the first panel as a pressure barrier for the inflatable structure such that the first and second panel form a cavity therebetween inflated with pressurized gas; and at least one linear attachment means attached to the first panel and the second panel for substantially retaining the first panel and second panel in a predetermined relationship to one another against pressure from the pressurized gas, wherein the at least one linear attachment means comprises at least one of a cord, a rope, a wire rope, a strap, a cable, a web, and a mesh, wherein said first panel further comprises at least two panel strips attached to one another and to a first webbing strip, the first webbing strip being substantially perpendicular to the first panel when the structure is inflated, wherein the at least one linear attachment means is attached to the webbing strip, wherein said second panel further comprises at least two panel strips attached to one another and to a second webbing strip, the second webbing strip being substantially perpendicular to the first panel when the structure is inflated, wherein the at least one linear attachment means is attached to the second webbing strip, wherein said first webbing strip further includes at least one grommet attached to the first webbing strip, for attaching the at least one linear attachment means, wherein said second webbing strip further includes at least one grommet attached to the second webbing strip, for attaching the at least one linear attachment means, wherein each of said at least one linear attachment means is attached to said first panel at an angle substantially normal to the surface of the first panel, and wherein said at least one linear attachment means comprises a plurality of linear attachment means, and wherein the average angle of attachment of the linear attachment means relative to their respective attachment points in the first panels is substantially 90 degrees.

7. A method of making an inflatable structure, comprising the steps of:

providing a first external panel provided as a pressure barrier for the method of making an inflatable structure;

providing a second panel substantially parallel to the first panel as a pressure barrier for the method of making an inflatable structure such that the first and second panel form a cavity therebetween inflated with pressurized gas; and providing at least one cord attached to the first panel and the second panel for substantially retaining the first panel and second panel in a predetermined relationship to one another against pressure from the pressurized gas, wherein said first panel further comprises at least two panel strips attached to one another and to a first webbing strip, the first webbing strip being substantially perpendicular to the first panel when the structure is inflated, wherein the at least one cord is attached to the webbing strip, wherein said second panel further comprises at least two panel strips attached to one another and to a second webbing strip, the second webbing strip being substantially perpendicular to the first panel when the structure is inflated, wherein the at least one cord is attached to the second webbing strip, wherein said first webbing strip further includes at least one grommet attached to the first webbing strip, for attaching the at least one cord, wherein said second webbing strip further includes at least one grommet attached to the second webbing strip, for attaching the at least one cord, wherein each of said at least one cord is attached to said first panel at an angle substantially normal to the surface of the first panel, and wherein said at least one cord comprises a plurality of cords, and wherein the average angle of attachment of the cords relative to their respective attachment points in the first panels is substantially 90 degrees.

8. The method of making an inflatable structure of claim 7, wherein said first panel further comprises at least to panel strips attached to one another and to a first webbing strip, wherein the at least one cord is attached to the webbing strip.

9. The method of making an inflatable structure of claim 8 wherein said second panel further comprises at least to panel strips attached to one another and to a second webbing strip, wherein the at least one cord is attached to the second webbing strip.

10. The method of making an inflatable structure of claim 8, wherein said first webbing strip further includes at least one grommet attached to the first webbing strip, for attaching the at least one cord.

11. The method of making an inflatable structure of claim 9, wherein said second webbing strip further includes at least one grommet attached to the second webbing strip, for attaching the at least one cord.

12. The method of making an inflatable structure of claim 7, wherein said at least one cord is attached to said first panel at an angle substantially normal to the surface of the first panel.

13. The method of making an inflatable structure of claim 7, wherein said at least one cord comprises a plurality of cords, and wherein the average angle of attachment of the cords relative to their respective attachment points in the first panels is substantially 90 degrees.

14. A method of making an inflatable structure, comprising the steps of:

providing a first external panel provided as a pressure barrier for the method of making an inflatable structure;

providing a second panel substantially parallel to the first panel as a pressure barrier for the method of making an inflatable structure such that the first and second panel form a cavity therebetween inflated with pressurized gas; and providing at least one mesh attached to the first panel and the second panel for substantially retaining the first panel and second panel in a predetermined relationship to one another against pressure from the pressurized gas, wherein said first panel further comprises at least two panel strips attached to one another and to a first webbing strip, wherein the at least one mesh is attached to the webbing strip.

15. The method of making an inflatable structure of claim 14, wherein said second panel further comprises at least two panel strips attached to one another and to a second webbing strip, wherein the at least one mesh is attached to the second webbing strip.

16. The method of making an inflatable structure of claim 6, wherein said at least one mesh is attached to said first panel at an angle substantially normal to the surface of the first panel.

17. The method of making an inflatable structure of claim 6, wherein said at least one mesh comprises a plurality of meshes, and wherein the average angle of attachment of the meshes relative to their respective attachment points in the first panels is substantially 90 degrees.

18. A method of making an inflatable structure, comprising the steps of:

providing a first external panel provided as a pressure barrier for the method of making an inflatable structure;

providing a second panel substantially parallel to the first panel as a pressure barrier for the method of making an inflatable structure such that the first and second panel form a cavity therebetween inflated with pressurized gas; and providing at least one linear attachment means attached to the first panel and the second panel for substantially retaining the first panel and second panel in a predetermined relationship to one another against pressure from the pressurized gas, wherein the at least one linear attachment means comprises at least one of a cord, a rope, a wire rope, a strap, a cable, a web, and a mesh, wherein said first panel further comprises at least two panel strips attached to one another and to a first webbing strip, the first webbing strip being substantially perpendicular to the first panel when the structure is inflated, wherein the at least one linear attachment means is attached to the webbing strip, wherein said second panel further comprises at least two panel strips attached to one another and to a second webbing strip, the second webbing strip being substantially perpendicular to the first panel when the structure is inflated, wherein the at least one linear attachment means is attached to the second webbing strip, wherein said first webbing strip further includes at least one grommet attached to the first webbing strip, for attaching the at least one linear attachment means, wherein said second webbing strip further includes at least one grommet attached to the second webbing strip, for attaching the at least one linear attachment means, wherein each of said at least one linear attachment means is attached to said first panel at an angle substantially normal to the surface of the first panel and wherein said at least one linear attachment means comprises a plurality of linear attachment means, and wherein the average angle of attachment of the linear attachment means relative to their respective attachment points in the first panels is substantially 90 degrees.

* * * * *